US005174225A

United States Patent [19]

Reise et al.

[11] Patent Number: 5,174,225

[45] Date of Patent: Dec. 29, 1992

[54] RELEASABLE AND TILTABLE TABLE TOP

[75] Inventors: Brian C. Reise, Colby; Thomas L. Scheller, Medford, both of Wis.

[73] Assignee: Colby Metal, Inc., Colby, Wis.

[21] Appl. No.: 578,428

[22] Filed: Sep. 5, 1990

[51] Int. Cl.[5] ..... A47B 13/02

[52] U.S. Cl. ..... 108/150; 108/4; 108/157

[58] Field of Search ..... 108/1, 4, 150, 157, 108/124; 49/382

[56] References Cited

U.S. PATENT DOCUMENTS 3,993,004 11/1976 Acme ..... 108/150
4,773,337 9/1988 Ball ..... 108/150

FOREIGN PATENT DOCUMENTS 0266083 10/1913 Fed. Rep. of Germany ..... 108/150
1316419 12/1963 France ..... 108/4
0047753 6/1909 Switzerland ..... 108/4

*Primary Examiner*—James R. Brittain
*Assistant Examiner*—Gerald A. Anderson
*Attorney, Agent, or Firm*—Reinhart, Boerner, Van Deuren, Norris & Reiselbach

[57] ABSTRACT

A table is provided having a table top, a table base and coupling means for removable and tiltable coupling said table to said base. The coupling means being releasible and comprising two pair of spring biased elements and receptacles arranged so that the table may be tilted in opposite directions.

7 Claims, 2 Drawing Sheets

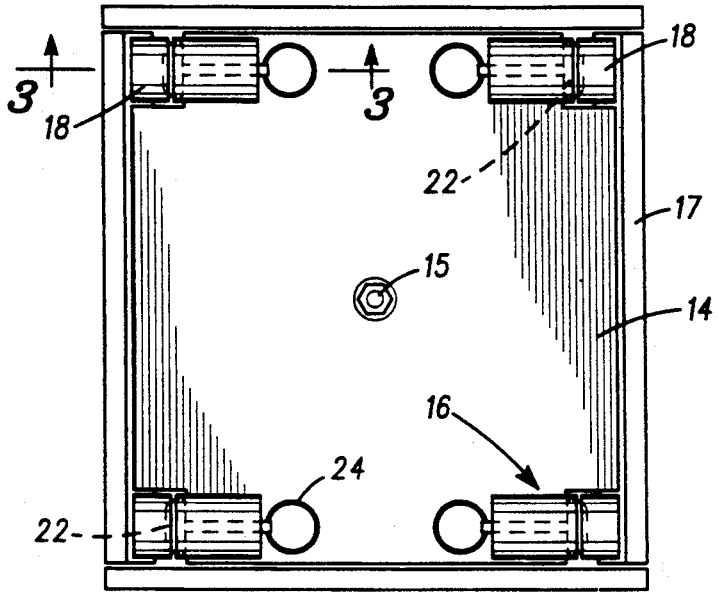
Fig. 2
Fig. 3
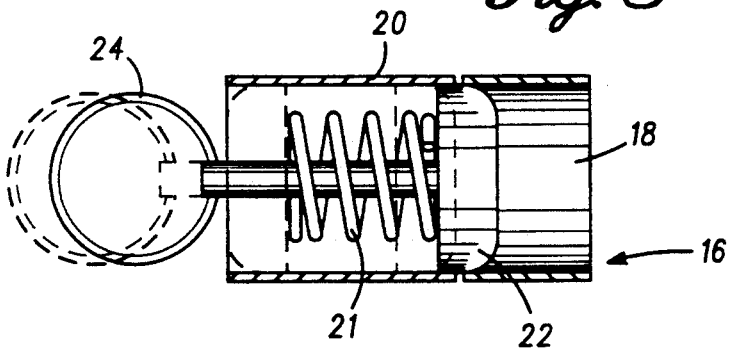
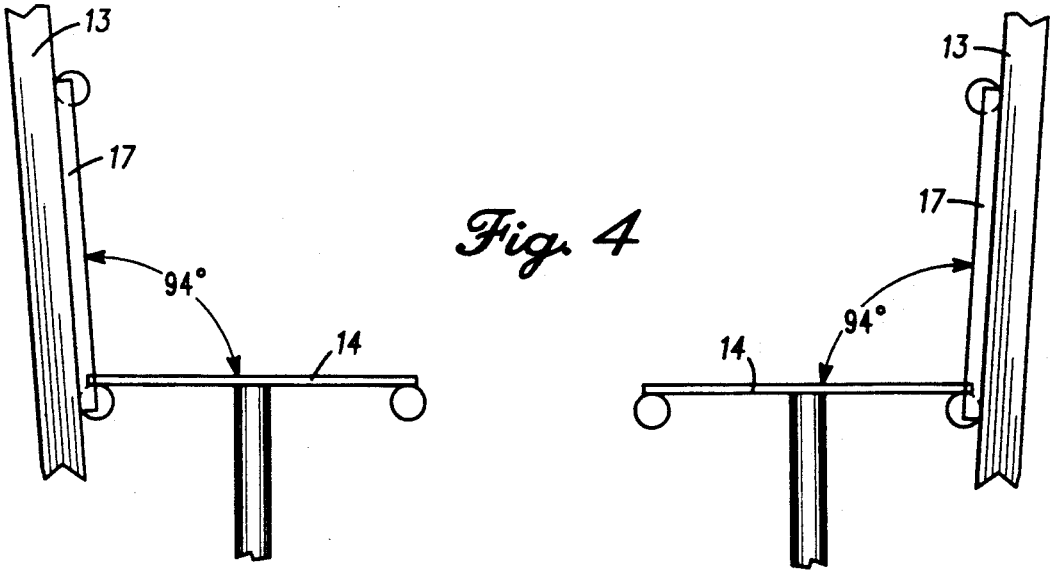
Fig. 4

RELEASABLE AND TILTABLE TABLE TOP

BACKGROUND OF THE INVENTION

The present invention is concerned generally with a table having a releasable and tiltable table top. More particularly, the invention is concerned with a table having a retractable coupling member attached to the table pedestal or to the table top for releasably and tiltably connecting the table top to the table pedestal.

In a number of commercial and institutional settings a large group of tables can be collected together for various purposes, such as, for dining, educational matters and entertainment settings. Frequently, it is necessary or desirable to temporarily consolidate the tables individually, as well as into a group, to make room for other events in a room. It is also desirable to be able to collapse the tables to either store them or enable easy access to the area beneath the table. Tables have been devised which collapse completely, but such tables are frequently not very sturdy and have a low quality appearance. Another variety of table does include the features of being able to remove the table top and also selectively tilt the table top to a vertical orientation. This type of table can be made to have a higher quality appearance; however, while these features are of the general variety desired for the subject invention, these previous structures embody relatively complicated latching and hinging mechanisms (see, for example, U.S. Pat. No. 3,993,004). Such complicated mechanisms tend to be difficult to work with, are easily abused and do not offer simple structures nor flexibility of use. Such complicated mechanisms also require more time and effort to make good use of the table and also can lead to breakdowns of the mechanism itself.

It is therefore an object of the invention to provide an improved releasable and tiltable table top.

It is a further object of the invention to provide a novel table with a table top which is releasably and tiltably attached to a table pedestal by a retractable coupling member.

It is another object of the invention to provide an improved table with a table top which is releasably and tiltably attached to a table pedestal by a spring loaded coupling member.

It is yet a further object of the invention to provide a novel table having a table top which can be tilted into a vertical position both sides of the table pedestal.

It is still an additional object of the invention to provide an improved tiltable table top which can be locked in place in the tilted or flat position and still be readily removed.

Further objects and advantages of the present invention, together with the organization and manner of operation thereof, will become apparent from the following detailed description of the invention when taken into conjunction with the accompanying drawings wherein like reference numeral designate like elements in the several views.

BRIEF DESCRIPTION OF THE DRAWINGS

FIG. 2 shows a bottom view of a spring loaded coupling member engaged to a receiving structure;

FIG. 3 illustrates a cross section taken along 3—3 in FIG. 2 and shows the details of the spring loaded plunger assembly; and FIG. 4 shows the table top tilt range provided by the spring loaded coupling member.

DETAILED DESCRIPTION OF THE PREFERRED EMBODIMENT

Figure 1:
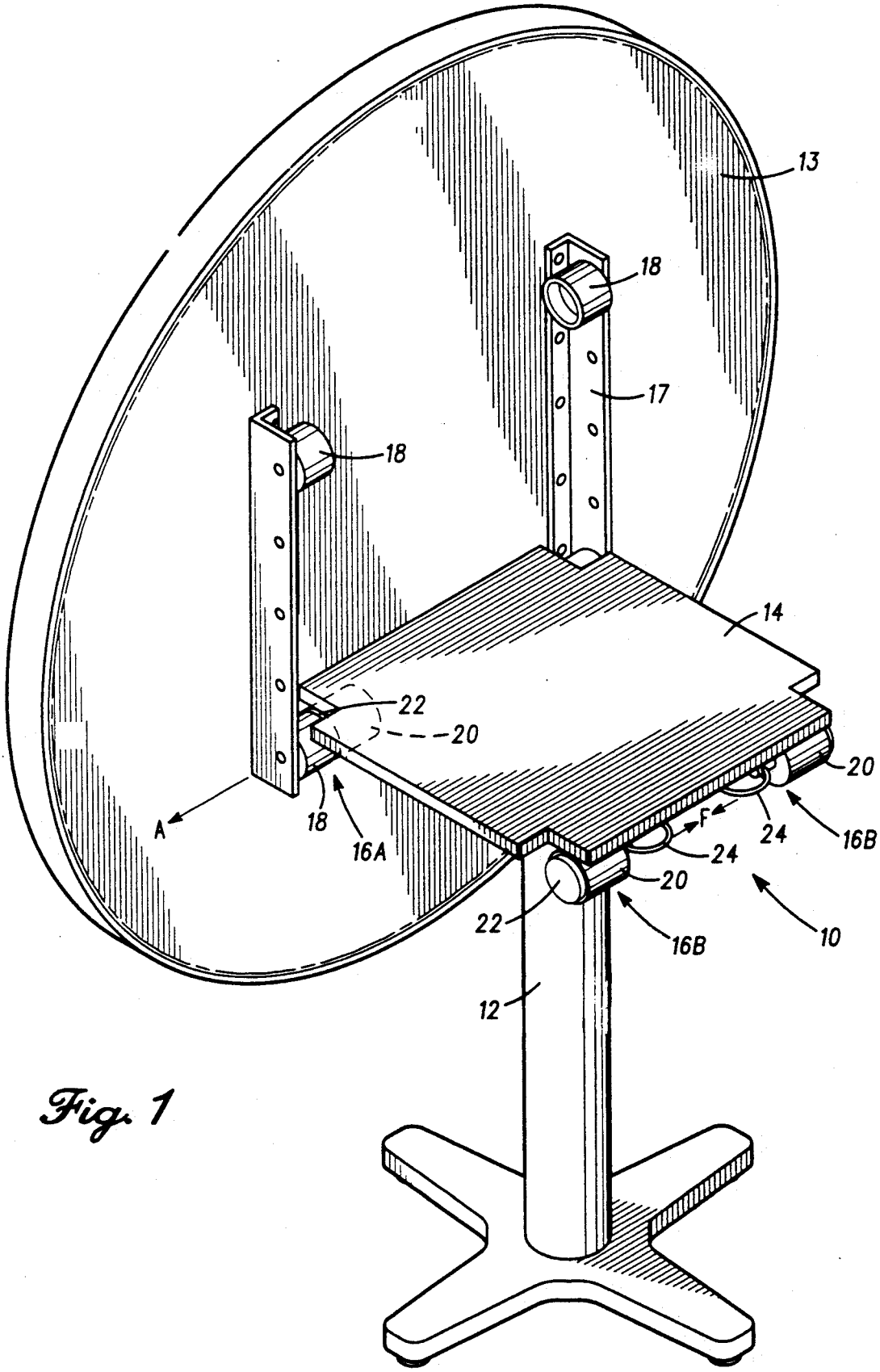
FIG. 1 illustrates in perspective a table constructed in accordance with the invention.

Referring now to the figures and more particularly to FIG. 1, a table constructed in accordance with the invention is indicated generally at 10. The table 10 includes a table pedestal 12 with an attached support plate 14. Coupling members 16, for retractably joining the table pedestal 12 to a table top 13, are affixed by conventional means (such as by fasteners not shown) to the four corners of the support plate 14. The support plate 14 is affixed by fastener 15 to the table pedestal 12. As shown in FIG. 1, the table top 13 is positioned in a vertical orientation as a consequence of being pivotally supported by one of a pair of the coupling members 16. In the illustrated embodiment only one member 16A is visible. The coupling members 16B can also be used, enabling the table top 13 to be pivoted or tilted vertically either side of the table pedestal 12. This feature greatly simplifies storage and cleaning around the table 10 and removal of the table top 13. Ordinarily, one would have to turn a substantial number of such tables 10 in order to optimize use of storage areas, to perform cleaning around and under the tables 10 and to conveniently remove the table top 13. The coupling members 16 are generally received by a receptacle 18 in the form of a hollow cylinder.

As seen best in FIG. 3, the coupling members 16 include a cylindrical housing 20 constructed to retain therein a plunger member 22. The plunger member 22 is also biased to the position shown by solid lines in FIG. 3. A spring 21, or other bias means, maintains this position until a user wishes to couple a table top 13 to the table pedestal 12. The coupling members 16 are engaged to the upper ones of the receptacles 18 which are fastened in a conventional manner to frame 17. The frame 17 is attached to the table top 13 by conventional fasteners 19. In order to complete engagement of the table top 13 to the coupling members 16, the table top 13 is rotated into a substantially horizontal position (see FIG. 1). Each of the plunger members 22 is then retracted within the cylindrical housing 20 to the positions shown in phantom, such as by a person pulling on handles 24 along direction F in FIG. 1. The table top 13 can then be lowered into its final horizontal position, and the plunger members 22 can be released to protrude from the cylindrical housing 20 and extend into engagement with the cylindrical opening of the receptacle 18. This coupling action completes the connection of the table top 13 to the table pedestal 12. Such a connection is extremely simple yet provides a strong, integral coupling which insures safe usage in either the tilted or flat position for the table top 13. The integral coupling further provides a rigid, high quality performance and still enables easy tilting and removal of the table top 13.

The spring loaded coupling member 16 connects the table top 13 to the table pedestal 12 in a releasable and tiltable manner. As shown schematically in FIG. 4, the table top 13 can be released from the table pedestal 12 by detaching one of the pair of the coupling members 16. The table top 13 can then be tilted to a substantially vertical position (also see FIG. 1). Upon disengagement of both pairs of the coupling members 16 one can completely remove the table top 13 from the table pedestal 12.

In other forms of the invention the coupling members 16 can be attached to the bottom of the table top 13 rather than to the table pedestal 12. The invention is also contemplated to include the coupling members 16 either on the table pedestal 12 or attached to the bottom of the table top 13. The coupling members 16 also need not be used in pairs, provided another pivotal mounting element can properly replace the second coupling member adjacent thereto. The frame 17 can include only two support members as shown in FIG. 1 or can include additional elements, such as the rigid four sided frame shown in FIG. 2.

In other embodiments the coupling member 16 can utilize other force biasing means to maintain the plunger member 22 in a normally protruding position. Also, in other forms of the invention the plunger member 22 can normally be maintained in a retracted position by a conventional latch or restraint means and released to a protruding position to engage with the receptacles 18.

While preferred embodiments have been illustrated and described, it should be understood that changes and modifications can be made therein without departing from the invention in its broader aspects. Various features of the invention are defined in the following claims.

What is claimed is:

1. A table having a table top, a table base and coupling means for removably and tiltably coupling said table to said base, said coupling means comprising two pair of spring biased coupling elements and receptacles, each element independent of the other elements and having an engaging position and a disengaging position, each said pair of said elements and said receptacles defining an axis about which said table top can tilt, relative to the base, when the other said pair of said elements are disengaged from the other said pair of said receptacles, each element having a handle and each pair of elements having handles facing each other, said handles providing means for grasping each said element when said element is to be moved from said engaging position, toward which said elements are all spring biased, to the disengaging position.

2. The table as defined in claim 1 wherein said spring biased coupling element comprises a plunger component.

3. The table as defined in claim 2 wherein said receptacle comprises a cylindrical housing for receiving said protruding plunger component.

4. The table as defined in claim 1 wherein said spring biased coupling element comprises a plunger member normally latched in the retracted position and releasable to a protruding position.

5. The table as defined in claim 1 wherein said receptacle comprises a housing for receiving said spring biased coupling element.

6. The table as defined in claim 1 wherein said coupling means is supported by a rigid, complete frame attached to said table top.

7. The table as defined in claim 1 further including means for fixing the angle of said table top relative to said table base.

* * * * *